US007520099B2

(12) United States Patent
Pringle et al.

(10) Patent No.: US 7,520,099 B2
(45) Date of Patent: Apr. 21, 2009

(54) PULTRUDED BUILDING PRODUCT AND SYSTEM

(75) Inventors: Todd Pringle, West Fargo, ND (US); John Jambois, Fargo, ND (US); Brian Tande, Fargo, ND (US)

(73) Assignee: Tecton Products, Fargo, ND (US)

( * ) Notice: Subject to any disclaimer, the term of this patent is extended or adjusted under 35 U.S.C. 154(b) by 298 days.

(21) Appl. No.: 11/130,823

(22) Filed: May 17, 2005

(65) Prior Publication Data

US 2006/0000170 A1 Jan. 5, 2006

Related U.S. Application Data

(60) Provisional application No. 60/571,970, filed on May 17, 2004.

(51) Int. Cl.
*B66C 23/06* (2006.01)

(52) U.S. Cl. ..... 52/408; 52/302.6; 52/302.1; 52/411

(58) Field of Classification Search ..... 52/302.1, 52/302.6, 408, 411, 413, 302.3, 120
See application file for complete search history.

(56) References Cited

U.S. PATENT DOCUMENTS 2,988,980 A * 6/1961 Tschudin ..... 454/296
3,230,995 A 1/1966 Shannon
3,318,056 A * 5/1967 Thompson ..... 52/105
4,100,710 A 7/1978 Kowallik
4,104,841 A 8/1978 Naz
4,184,301 A 1/1980 Anderson et al.
4,258,520 A 3/1981 Rehbein
4,391,068 A * 7/1983 Kosar ..... 52/97
4,637,191 A * 1/1987 Smith ..... 52/522
4,788,088 A * 11/1988 Kohl ..... 428/34.5
5,050,362 A 9/1991 Tal et al.
5,131,200 A 7/1992 McKinnon
5,564,245 A 10/1996 Rademacher
5,617,687 A * 4/1997 Bussey et al. ..... 52/404.2
5,732,520 A 3/1998 Maietta
5,800,651 A 9/1998 Williamson
5,819,486 A 10/1998 Goodings
5,878,543 A 3/1999 Mowery
6,122,877 A * 9/2000 Hendrickson et al. ..... 52/520
6,128,879 A * 10/2000 Bussey et al. ..... 52/408
6,197,412 B1 3/2001 Jambois et al.
6,293,064 B1 * 9/2001 Larson ..... 52/302.1
6,311,456 B1 11/2001 Rodero Antunez
6,314,704 B1 * 11/2001 Bryant ..... 52/745.1
6,355,333 B1 * 3/2002 Waggoner et al. ..... 428/174

(Continued)

OTHER PUBLICATIONS

"U.S. Appl. No. 11/130,828, Response filed Mar. 4, 2008 to Non-Final Office Action mailed Sep. 4, 2007", 9.

(Continued)

*Primary Examiner*—Basil Katcheves
(74) *Attorney, Agent, or Firm*—Schwegman, Lundberg & Woessner, P.A.

(57) ABSTRACT

A building product includes a pultruded composite profile having an inner wall and an outer wall, wherein the inner wall includes a level of porosity such that water vapor is able to diffuse through the inner wall, but liquid water cannot substantially penetrate the inner wall.

18 Claims, 3 Drawing Sheets

U.S. PATENT DOCUMENTS

| | | | | |
|---|---|---|---|---|
| 6,365,081 | B1 | 4/2002 | Beck | |
| 6,401,428 | B1 * | 6/2002 | Glover et al. | 52/786.13 |
| 6,415,574 | B2 * | 7/2002 | Beck | 52/519 |
| 6,470,638 | B1 | 10/2002 | Larson | |
| 6,515,062 | B2 | 2/2003 | Jesionka | |
| 6,516,580 | B1 | 2/2003 | Maietta | |
| 6,591,567 | B2 | 7/2003 | Hota et al. | |
| 6,594,965 | B2 | 7/2003 | Coulton | |
| 6,637,163 | B2 | 10/2003 | Thibault et al. | |
| 6,871,600 | B2 | 3/2005 | Norton et al. | |
| 6,926,785 | B2 * | 8/2005 | Tanzer et al. | 156/87 |
| 7,114,304 | B2 | 10/2006 | Aota et al. | |
| 7,127,865 | B2 | 10/2006 | Douglas | |
| 2001/0004816 | A1 | 6/2001 | Boyer | |
| 2002/0123288 | A1 | 9/2002 | Davies et al. | |
| 2002/0148382 | A1 | 10/2002 | Norton et al. | |
| 2003/0019175 | A1 | 1/2003 | Kremers | |
| 2003/0136072 | A1 | 7/2003 | Peng | |
| 2004/0182028 | A1 | 9/2004 | Belleau | |
| 2005/0252139 | A1 | 11/2005 | Pringle et al. | |
| 2005/0262791 | A1 | 12/2005 | Pringle | |
| 2006/0096217 | A1 | 5/2006 | Lance et al. | |

OTHER PUBLICATIONS

"Non-Final Office Action Mailed Sep. 4, 2007 in U.S. Appl. No. 11/130,828", OARN,9 pgs.

U.S. Appl. No. 11/032,315: Non-Final Office Action mailed Apr. 8, 2008, 13 pgs.

U.S. Appl. No. 11/032,315: Response filed Sep. 12, 2008 to Non Final Office Action mailed Apr. 8, 2008, 10 pgs.

U.S. Appl. No. 11/130,828: Final Office Action mailed Jun. 2, 2008, 14 pgs.

U.S. Appl. No. 11/130,828: Response filed Sep. 2, 2008 to Final Office Action mailed Jun. 2, 2008, 8 pgs.

Mexican Application Serial No. PA/a/2005/005295: Office Action mailed Jul. 29, 2008, 10 pgs.

* cited by examiner

PULTRUDED BUILDING PRODUCT AND SYSTEM

CROSS-REFERENCE TO RELATED APPLICATION

This application claims the benefit under 35 U.S.C. 119(e) of U.S. Provisional Application No. 60/571,970 filed on May 17, 2004, which is hereby incorporated by reference in its entirety.

FIELD

This application relates generally to building products and more specifically to a pultruded building product.

BACKGROUND

Pultruded profiles have found use in window frames and door frames and are known for their strength and rigidity among other properties. Pultrusions are typically solid, non-porous materials that are relatively impermeable to liquid water and water vapor. For some building products it is desirable to have a higher rate of water vapor transmission than what is typical of pultruded products, while still maintaining an impenetrability to liquid water. Such building products include weather barriers, which are thin sheets of extruded film or nonwoven fabric which allow a house to transmit water vapor to the exterior yet keep liquid water and wind from entering a house. Weather barriers are used because current building materials lack these beneficial properties. Commercially available weather barriers are limited, however, in that they can be easily torn or punctured, which then reduces their effectiveness.

SUMMARY

A building product includes a pultruded composite profile having an inner wall and an outer wall, wherein the inner wall includes a level of porosity such that water vapor able to diffuse through the inner wall, but liquid water cannot substantially penetrate the inner wall.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that the embodiments may be combined or that other embodiments may be utilized and that structural changes may be made without departing from the spirit and scope of the present invention. The following detailed description is, therefore, not to be taken in a limiting sense, and the scope of the present invention is defined by the appended claims and their equivalents.

Figure 1A:
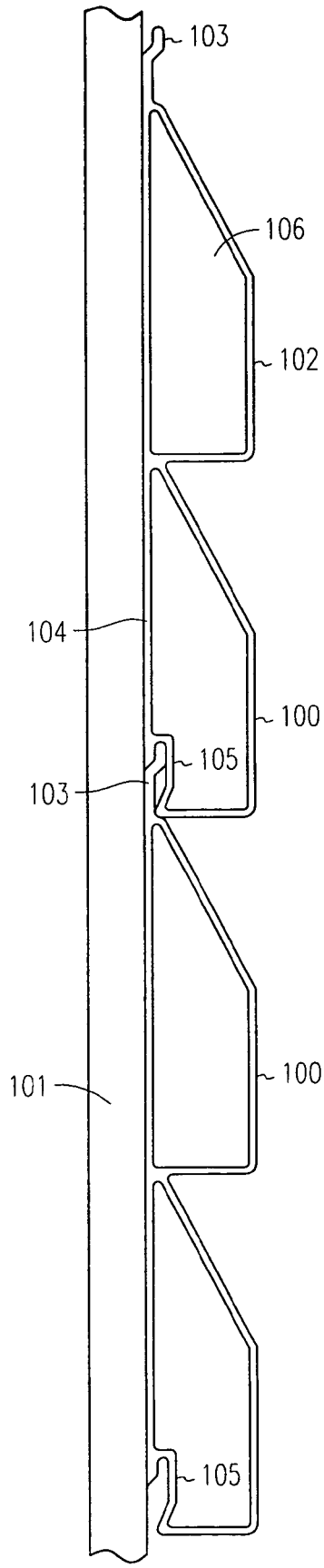
FIG. 1A shows a cross-section profile of a pultruded building product according to one embodiment.

FIG. 1A shows a cross-section of a pair of pultruded members 100 according to one embodiment. Members 100 are pultruded members that form the exterior of a building. In one embodiment, members 100 replace the sheathing, weather barrier, and/or siding of typical construction. Members 100 can be nailed or screwed or otherwise fastened directly to the frame 101 of the structure. Thus, for example, a plurality of members 100 are fastened directly to the 2"×4"s or 2"×6"s used to build the frame of a house. Each pultruded member 100 can include an upper joint section 103 and a lower joint section 105 that form an interlocking joint when two pultruded members are placed adjacent to each other. In some examples, members 100 can be nailed or fastened to sheathing which is fastened to frame 101.

The members 100 are formed by pultrusion and can include a coating or a film for additional protection from elements or ultraviolet protection. For example, the pultrusion and coating can be as described in commonly assigned U.S. Pat. No. 6,197,412, which is incorporated herein by reference in its entirety. Members 100 can be various heights, for example, from a foot or less to 4 feet or more. They can have lengths of up to 30 feet or longer.

The present pultruded siding product members 100 are not be susceptible to warping due to expansion or softening at elevated temperatures such as vinyl or metal siding. Moreover, they allow for the elimination of installation slots, which makes the product easier to install, requiring less time and labor. Also, the pultruded members could also be installed with any color.

Moreover, since the pultruded members have a relatively high insulative property, they help the insulating value of a structure wall and are less likely to be condensation points for moisture. In some examples, members 100 can include any features as described in co-pending, commonly assigned U.S. application Ser. No. 11/032,315, filed Jan. 10, 2005, which is incorporated herein by reference.

In one embodiment, the pultruded products 100 allow water vapor to pass through, while blocking wind and bulk water, such as rain, such that the products inherently incorporate a weather barrier with a siding product so as to reduce the needed labor and time to construct a building. Accordingly, they provide a building product with the strength and rigidity of a pultrusion but which also possesses the properties of high water vapor transmission rate, liquid water barrier and wind barrier, as found in weather barrier.

In one embodiment, pultruded construction members 100 combine all the functionality of sheathing, weather barriers, and/or siding to reduce the labor and time needed to construct a building. The construction members 100 are designed and structured to offer similar or greater structural support and shear strength to a building versus OSB to allow for a stronger structure, and/or cost savings on other structural members of a building.

Each member 100 includes an outer wall 102 and an inner wall 104 with a cavity or hollow 106 therebetween. Wall 102 is generally solid and is impermeable to wind and rain and can include a weather coating. As will be discussed below, inner wall 104 is designed to allow water vapor to pass through wall 104 while liquid water cannot substantially penetrate the inner wall. This means that liquid water, such as from condensed water vapor, rain, or in droplet form, cannot pass through the inner wall in sufficient quantity so as to cause structural problems to the building.

Figure 1B:
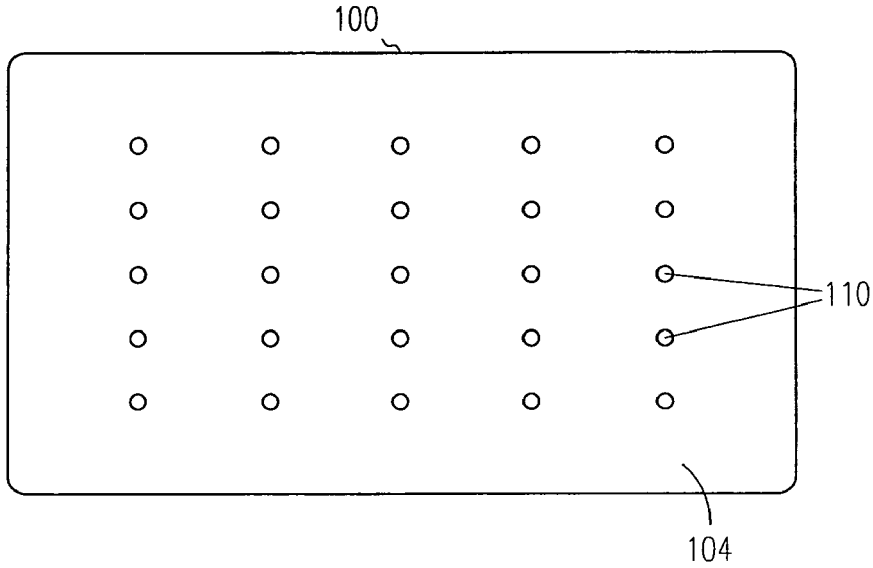
FIG. 1B shows a portion of the surface of the pultruded member of FIG. 1 that contains numerous small holes.

FIG. 1B shows a portion of the surface of wall 104 of pultruded part 100 that contains numerous small holes 110 according to one embodiment. In this example, the small holes 110 are of a size such that water vapor is allowed to diffuse through them, but liquid water would not pass through due to the effect of surface tension. The ability of the pultrusion to hold out bulk liquid water is a function of both the surface energy of the pultrusion and the size of the holes. The surface energy can be tailored by, for example, using a different resin system, adjusting the loading or type of fiberglass or filler, or by changing the chemistry of sizing on the fiberglass. The small holes 110 could be created by, for example laser drilling or mechanical perforation, although other methods may be used. In various embodiments, holes 110 can be about 0.003" or less or up to about 0.030" or greater. Some embodiments have holes of about 0.030" or less. The density of holes on the surface of the pultrusion can be about 1 hole per square inch, about 100 holes per square inch, about 400 holes or more per square inch, between about 1 and about 100 holes per square inch, and between about 1 and about 400 holes per square inch. Lasers capable of producing small holes in fiberglass pultrusions include carbon dioxide ($CO_2$) lasers, available from PRC Lasers (Landing, N.J.), and neodymium-doped yttrium aluminum garnet (Nd:YAG) lasers, available from GSI Lumonics (Billerica, Mass.), among others.

Figure 2:
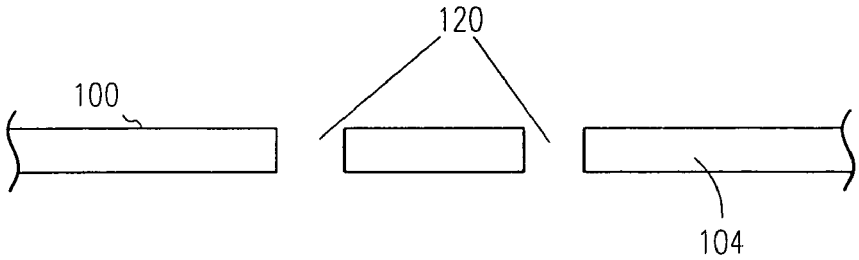
FIG. 2 shows a cross section view of a pultruded profile according to one embodiment.
Figure 3:
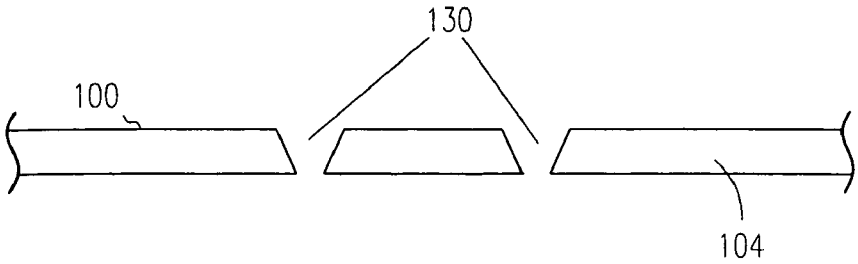
FIG. 3 shows a cross section view of a pultruded profile according to one embodiment.

FIGS. 2 and 3 show a cross-sectional view of the holes 110. In one example, the small holes 120 may be generally cylindrical in shape. In another example, it may be beneficial for the small holes 130 to be tapered such that the hole has a larger diameter on one surface than on the other.

Figure 4:
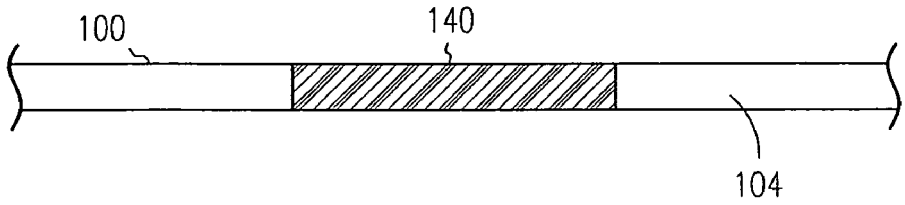
FIG. 4 shows a cross-section view of a portion of a pultruded profile according to one embodiment.

FIG. 4 shows one embodiment of the invention in which a portion of wall 104 contains a material 140 that has a relatively high rate of water vapor transmission. Such a material could be a nonwoven fabric comprised of thermoplastic fibers, an extruded plastic film that is embossed or perforated, or any other material with the properties of a weather barrier as described above so as to allow water vapor to pass through the wall while liquid water cannot substantially penetrate the inner wall. The material could be in more than one region of the profile and could be added to the part either during the pultrusion process or after the part has been made. For example, one or more bands of material 140, each being about a millimeter wide, 10 millimeters wide, or 100 millimeter wide or greater can be incorporated into the pultrusion. In some examples, the entire wall of the pultrusion can be the material 140.

Figure 5:
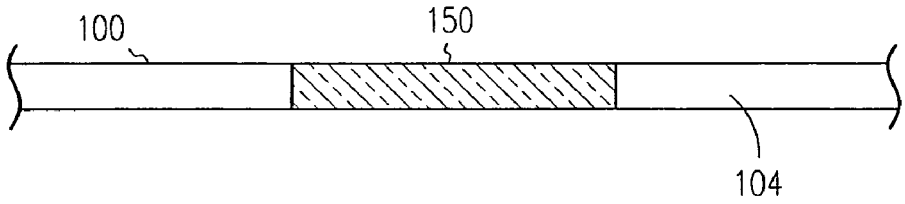
FIG. 5 shows a cross-section view of a portion of a pultruded profile according to one embodiment.

FIG. 5 shows one embodiment of the invention in which a highly porous section 150 has been incorporated into the wall 104 of profile 100 in such a way that it allows for the diffusion of water vapor. The material in this porous section 150 could be comprised of a pultrusion resin that has a high loading of fillers or glass, contains a volatile solvent, or contains chopped fiberglass strands. Alternatively, the porous section could contain a fiberglass reinforcement that has intentionally been poorly wet out by the pultrusion resin.

Figure 6:
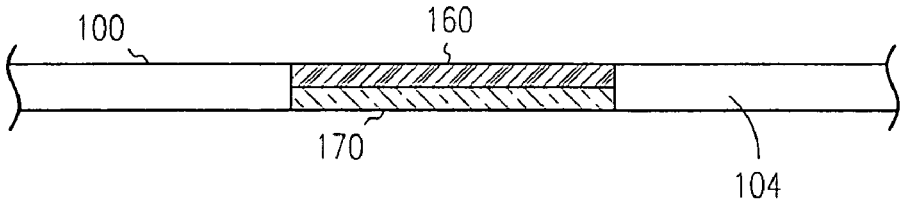
FIG. 6 shows a cross-section view of a portion of a pultruded profile according to one embodiment.

FIG. 6 shows a cross section view of one embodiment in which a portion of the wall 104 of pultruded profile 100 contains a highly porous section 170 which is then covered with a material 160 that has the properties of a weather barrier as described above. The material could be in more than one region of the profile and could be added to the part either during the pultrusion process or after the part has been made.

In some embodiments the profile 100 is pultruded and formed as a composite part. For example, glass, or other reinforcing fibers, are impregnated with resin and pulled through a forming guide and a heated die. The forming guide orients the fibers to be properly placed in the heated die to insure that the pultruded part has uniform reinforcement across its shape. The heated die cures and/or solidifies the resin around the reinforcing fibers, thus forming the composite part. The composite part, having a profile shape, is continuously pulled out of the heated die by a puller. The puller can be a clamp and stroke action from a reciprocating puller, or a smooth action from a caterpillar puller.

Reinforcing fibers used in the example pultrusions can be glass, carbon fiber, kevlar, and other organic and inorganic filaments and fibers. Reinforcement fibers can take the form of filament and strand bundles, called rovings. They also take the form of yarns, texturized yarns, chopped strand mats, continuous strand mats, knitted mats, woven mats, surfacing veils, and many hybrid combinations of rovings, yarns, mats, and veils.

Resin used in example pultrusions can be thermosetting resins like unsaturated polyesters in a styrene solution, or polyurethanes, phenolics, epoxides, thermosetting blends, and other thermosetting resins. Other resins used in pultrusion can be thermoplastic resins based on polyurethanes, acrylics, polyethylenes, and other thermoplastic resins. Resin used in pultrusion can also be thermoplastic resins that are embedded in rovings that melt and form the part inside the pultrusion die.

Resin mixtures in pultrusion can also contain organic, polymeric, and inorganic additives for such properties as shrink control, mold lubrication, colorants, fillers and other specially additives.

Accordingly, the present system provides a breathable pultrusion. In some embodiments, the pultrusion can contain numerous small holes which are of such a size as to allow water vapor to diffuse yet prevent liquid water from passing. In some embodiments, these holes have been drilled using a laser. In some embodiments, the pultrusion has been punctured with a needle. In some embodiments, the pultrusion has been made porous by incorporating high levels of fillers or glass reinforcement. In some embodiments, the pultrusion has been made porous by the addition of a volatile solvent to the pultrusion resin prior to curing. In some embodiments, a pultruded part has been made with portions of the profile containing a material with an inherently high water transmission rate, possibly including materials currently used as weather barriers.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A building product comprising:

a substantially rigid pultruded composite exterior siding profile having an inner wall integrally formed with a multiplanar outer wall, the inner and outer walls forming a closed perimeter around a hollow space extending along the length of the profile, wherein the inner wall includes a level of porosity configured to allow water vapor to diffuse through the inner wall, but inhibit liquid water from passing through the inner wall.

2. The building product of claim 1, wherein the inner wall includes a plurality of holes.

3. The building product of claim 2, wherein each of the plurality of holes are about 0.030 inches in diameter or less.

4. The building product of claim 2, wherein the density of the plurality of holes is between 1 and about 400 holes per square inch.

5. The building product of claim 2, wherein each of the plurality of holes are tapered.

6. A building product comprising:

a substantially rigid pultruded composite exterior siding profile having an inner wall integrally formed with a multiplanar outer wall, the inner and outer walls forming a closed perimeter around a hollow space extending along the length of the profile, wherein the inner wall includes a level of porosity configured to allow water vapor to diffuse through the inner wall, but substantially inhibit liquid water from passing through the inner wall, wherein the inner wall includes a material having a relatively high rate of water vapor transmission to allow water vapor to diffuse through the inner wall, but inhibit liquid water from passing through the inner wall.

7. The building product of claim 6, wherein the material includes a porous pultruded section of the inner wall.

8. The building product of claim 6, wherein the building product is adapted to perform as sheathing and siding of a building.

9. The building product of claim 6, wherein the building product is adapted to perform as sheathing and weather barrier of a building.

10. A building product comprising:

a substantially rigid composite pultruded exterior siding profile including a first wall integrally formed with a multiplanar second wall, the first and second walls forming a closed perimeter around a hollow space extending along the length of the profile, the first wall having a plurality of holes sized to allow water vapor to diffuse through the holes, but inhibit liquid water from passing through the holes.

11. The building product of claim 10, wherein the plurality of holes are up to 0.030 inches in diameter.

12. The building product of claim 10, wherein the density of the plurality of holes is between 1 and 400 holes per square inch.

13. The building product of claim 10, wherein the plurality of holes are tapered.

14. The building product of claim 10, wherein the building product is adapted to perform as weather barrier and siding of a building.

15. The building product of claim 10, wherein the building product is adapted to perform as sheathing and weather barrier of a building.

16. A method comprising:

fastening a plurality of pultruded exterior siding members to a building, each pultruded exterior siding member including an inner wall abutting the building, the inner wall integrally formed with a multiplanar outer wall, the inner and outer walls forming a closed perimeter around a cavity extending along the length of each of the pultruded exterior siding members, the inner wall including a level of porosity configured to allow water vapor to diffuse through the inner wall, but inhibit liquid water from passing through the inner wall.

17. The method of claim 16, wherein the inner wall includes a plurality of holes.

18. The method of claim 16, wherein the inner wall includes a material having a relatively high rate of water vapor transmission to allow water vapor to diffuse through the inner wall, but inhibit liquid water from passing through the inner wall.

* * * * *